United States Patent [19]

Green

[11] Patent Number: 4,818,963

[45] Date of Patent: Apr. 4, 1989

[54] DIELECTRIC WAVEGUIDE PHASE SHIFTER

[75] Inventor: Jerome J. Green, Lexington, Mass.

[73] Assignee: Raytheon Company, Lexington, Mass.

[21] Appl. No.: 796,505

[22] Filed: Nov. 12, 1985

Related U.S. Application Data

[63] Continuation of Ser. No. 741,710, Jun. 5, 1985, abandoned, which is a continuation of Ser. No. 559,141, Dec. 7, 1983, abandoned.

[51] Int. Cl.[4] ..... H01P 1/195

[52] U.S. Cl. ..... 333/24.1; 333/239; 342/372

[58] Field of Search ..... 333/17 L, 24.1, 24.2, 333/158, 239

[56] References Cited

U.S. PATENT DOCUMENTS

| | | | |
|---|---|---|---|
| 2,595,078 | 4/1952 | Iams | 333/239 |
| 3,425,001 | 1/1969 | Hershenov | 333/24.1 X |
| 3,524,152 | 8/1970 | Agrios et al. . | |
| 3,539,950 | 11/1970 | Freibergs | 333/24.1 X |
| 3,938,158 | 2/1976 | Birch et al. . | |
| 4,034,377 | 7/1977 | Knox et al. . | |

OTHER PUBLICATIONS

"Foundations for Microwave Engineering" by R. E. Collins, McGraw-Hill, Inc., 1966, N.Y., N.Y., pp. 266–271.

*Primary Examiner*—Paul Gensler

*Attorney, Agent, or Firm*—Denis G. Maloney; Richard M. Sharkansky

[57] ABSTRACT

A nonreciprocal latching phase shifter includes a slab of a high dielectric contant material disposed within a closed magnetization path provided in response to a current fed through a ferrite toroid. A substantial portion of the electromagnetic energy is confined to the dielectric slab, with a remaining small portion of such energy leaking from the slab and interacting with the adjacent ferrite whose state of magnetization is varied in response to the current fed through the ferrite to provide a predetermined phase shift to the electromagnetic energy. In one embodiment, a plurality of parallel high dielectric bars is disposed within a ferrite toroid providing the closed magnetization path to provide a low-cost single toroid multi-element phase shifter. In a second embodiment, a plurality of ferrite toroids, each having a second plurality of dielectric members disposed therein, is arranged to provide a low-cost phase shifter array. In an additional alernate embodiment, a pair of orthogonally disposed phase shifter arrays are spaced by a phase rotation array to provide an array antenna with the vertical and horiozntal beam steering segregated between such arrays.

27 Claims, 10 Drawing Sheets

DIELECTRIC WAVEGUIDE PHASE SHIFTER

This application is a continuation of application Ser. No. 741,710 filed June 5, 1985 which is a continuation of application Ser. No. 559,141 filed Dec. 7, 1983 both of which prior applications have been abandoned.

BACKGROUND OF THE INVENTION

This invention relates to phase shifters and more particularly to phase shifters employing a ferrite slab.

As is known in the art, phase shifters have a wide variety of applications in microwave circuits. More specifically, phase shifters have been used in phased array antennas to electronically produce a scanning beam. Of particular interest in these applications is the ferrimagnetic latching phase shifter. It is generally constructed by inserting one or more ferrite toroids in a metal waveguide. Close tolerances must be maintained to avoid the generation of undesirable higher order modes in the minute air gaps between the surfaces of the ferrite and the waveguide. U.S. Pat. Nos. 3,761,845 and 4,001,733 are representative of the schemes developed to avoid this problem. However, they all involve additional manufacturing steps which, in the patents referenced above, require, respectively, wrapping a foil around a composite structure and plating the ferrite assembly.

Another problem of ferrimagnetic phase shifters is that the thermal expansion of the metal waveguide is different from the thermal expansion of the ferrite material. This results in damaging stresses or unwanted movement of the ferrite core within the waveguide in addition to the problems caused by magnetostriction, U.S. Pat. No. 3,849,746 shows a possible mounting method that avoids this problem. However, this also has the disadvantage of requiring additional manufacturing steps.

One solution to this problem, as described in my copending patent application Ser. No. 272,809 filed on June 11, 1983, now U.S. Pat. No. 4,434,409, issued Feb. 28, 1984 includes a dielectric slab disposed adjacent to a ferrite toroid to provide the phase shifter.

SUMMARY OF THE INVENTION

In accordance with the present invention, a phase shifter assembly which avoids these and other problems of conductive waveguide type ferrimagnetic devices is described. The phase shifter includes a high-K dielectric slab as the primary channel for microwave energy thus eliminating the conductive walls of the waveguide. A cost advantage is also gained, since the number and difficulty of fabrication steps can be reduced. As used in this context, a high-K dielectric is a material having a dielectric constant greater-than one order of magnitude of the dielectric constant of free space.

This invention provides for means for containing a propagating electromagnetic wave comprising a high-K dielectric slab, means comprising a dielectric interface for producing a predetermined amount of wave leakage from the surface of the slab, and means, disposed adjacent to the dielectric slab, for producing ferrimagnetic interaction with a portion of the leakage wave.

This invention further provides for a first and second sheet of ferrimagnetic material disposed parallel to each other, and a plurality of parallel dielectric bars disposed longitudinally between the first and second sheets. Each of the sheets have parallel longitudinal passages at a predetermined spacing from each other. The passages in the first sheet are adjacent corresponding passages in the second sheet, and each of said dielectric bars is disposed longitudinally between the two sheets in the region between oppositely adjacent passages.

In accordance with an alternate embodiment of the present invention, a phase shifter includes a first ferrite sheet and a pair of ferrite bars disposed on a first facial surface of said first ferrite sheet. A dielectric member having a dielectric constant selected to confine electromagnetic energy fed thereto is disposed between the pair of ferrite bars and on said first surface of said sheet. A second sheet of ferrite is then disposed over the ferrite bars and dielectric member. With such an arrangement, the first and second ferrite sheets and the pair of ferrite bars, that is, the ferrite members, are arranged to provide a closed magnetization path or toroid around the dielectric member. A conductor is disposed through such path and a current is fed to such conductor to provide in combination with the ferrite members a selectable magnetization in such path. A predetermined amount of electromagnetic wave leakage is provided from the dielectric member which interacts with the magnetization in the ferrite members to provide in response to such interaction, a predetermined amount of phase shift to such electromagnetic wave as such wave propagates through the dielectric member.

In accordance with an additional aspect of the present invention, a plurality of dielectric members for guiding a plurality of electromagnetic waves is disposed within the above-described closed magnetization path. With such an arrangemet, a single toroid multi-element shifter is provided. Such a phase shifter is a compact structure since the plurality of dielectric members is disposed within the closed magnetization path provided by the ferrite members. Further, the above-described phase shifter is relatively easy to construct and to incorporate in an array thus providing a low-cost easily manufacturable alternative to the metal waveguide phase shifter based array. Further still, by providing a plurality of spaced dielectric members within a single magnetization path, each one of such plurality of guided waves is provided the same selectable predetermined phase shift by switching the magnetization in a single path.

In accordance with a further aspect of the present invention, a phased array antenna system includes a pair of two-dimensional arrays spaced by a wave polarization rotational array. Each one of such two-dimensional arrays includes a plurality of the above-mentioned single toroid multi-element phase shifters. A first one of such pair of two dimensional arrays is orientated to steer electromagnetic energy in a first one of horizontal and vertical directions, and a second one of such two-dimensional arrays is orientated to steer electromagnetic wave energy in a second, different one of such horizontal and vertical directions. The pair of two-dimensional arrays are arranged such that the dielectric members of the first one of such arrays is rotated 90° with respect to the dielectric members of the second one of such arrays. The polarization rotational array is then disposed between said arrays to rotate the E-field polarization of an applied electromagnetic wave to permit such electromagnetic wave to be coupled between such arrays. With such an arrangement, a low-cost, compact phased array antenna system is provided. Further, by providing two spaced arrays, horizontal and vertical beam steering functions are separated, with one of such arrays providing the horizontal beam steering and the other one of such arrays providing vertical beam steering. Further still, control of phase shifting to provide the horizontal and vertical beam steering is simplified because each one of such single dimensional arrays provides phase shift to a plurality of guided waves by controlling the magnetization in a single magnetization path surrounding the members which guide such plurality of waves. This arrangement also reduces the complexity involved in providing beam steering control for relatively complex arrays, since only rows or columns comprising a plurality of such single toroid multi-element phase shifts are selectively switched.

BRIEF DESCRIPTION OF THE DRAWINGS

The foregoing features of the invention, as well as the invention itself, may be more fully understood from the following detailed description of the drawings, in which.

DESCRIPTION OF THE PREFERRED EMBODIMENT

Figure 1:
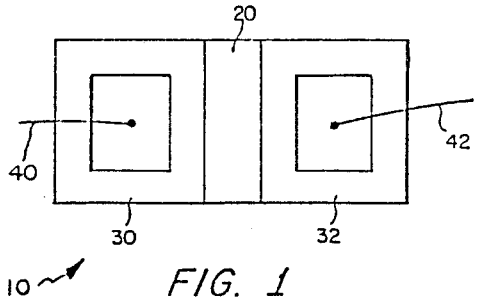
FIG. 1 shows an elevation view of the embodiment of the phase shifter.

Referring now to FIG. 1, there is shown an exemplary nonreciprocal twin ferrite slab dielectric waveguide phase shifter 10 of the present invention. High-K rectangular slab 20 is positioned between two ferrite toroids 30 and 32 and is bonded thereto by any suitable means, such as an acrylic reactive adhesive, for instance, methyl methacrylate No. RA-0018 sold by H. B. Fuller, Saint Paul, Minn. The bond provides the required flexibility over the operating temperature range to relieve the stresses arising from the difference in coefficients of expansion between slab 20 and toroids 30 and 32. The high-K dielectric 20 is the primary channel for the microwave energy, and the RF fields outside the dielectric decay rapidly. This is achieved by selecting a dielectric constant K for the dielectric slab 20 that is several times that of the K for the ferrite toroids 30 and 32. Under this condition, the high-K slab 20 is entirely surrounded by a layer made up of lower-K dielectric materials, i.e., the adjacent leg of each ferrite toroid on two of the opposite sides of slab 20 and air on the remaining two sides. This structure provides a peripheral dielectric interface boundary between media having different dielectric constants, which results in an electromagnetically mismatched interface boundary and thus forms a dielectric waveguide. An applied electromagnetic wave, then, is guided along the core of this dielectric waveguide, since the impedance mismatching at the interface boundary serves to produce internal reflections, thus containing most of the energy. The mismatched interface boundary does allow a small portion of the applied wave to transmit through this layer, however, the different dielectric constants are chosen to produce an exponentially decaying transmitted wave. Use of the dielectric waveguide also serves to reduce the size of the device for a predetermined amount of phase shift. The reduced volume of the ferrite toroid has the cost advantage of requiring a lesser quantity of the normally expensive ferrite material and, in the case of a latching device, also requires less switching energy. Outside the dielectric slab 20, the exponentially decaying microwave energy penetrates only a portion of the adjacent legs of ferrite toroids 30 and 32 and is sufficient to provide the required phase shifting without excessive coupling to the other legs of toroids 30 and 32.

Figure 2:
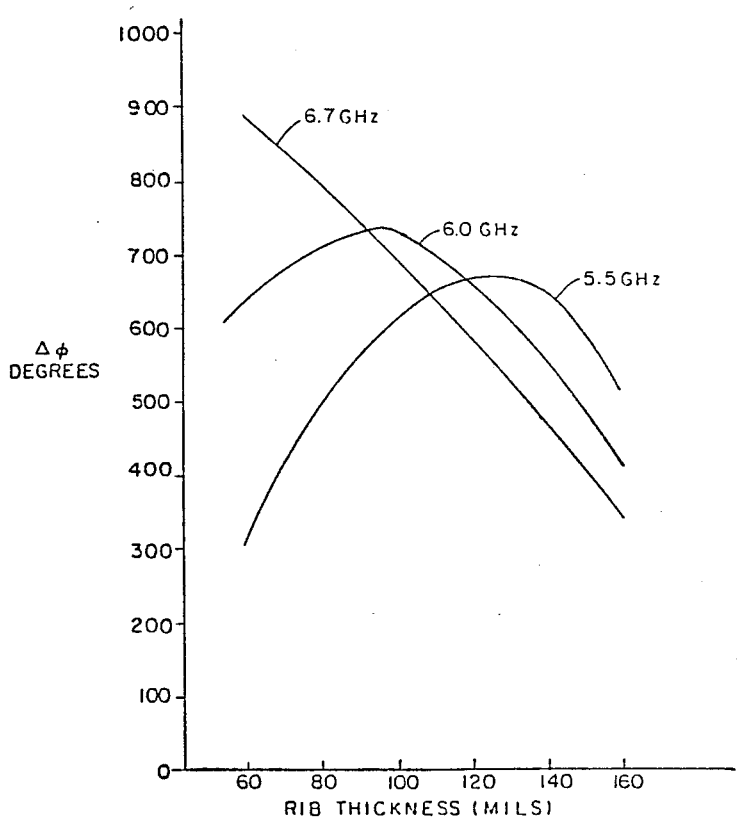
FIG. 2 shows a graph of achievable phase shift as a function of the thickness of the dielectric slab for the phase shifter of FIG. 1.

Switching wires 40 and 42 thread the length of toroids 30 and 32, respectively, and are used to supply the magnetizing current pulse. Other arrangements of switching wires may be used to provide the required magnetization. As is well-known, the direction and duration of the current pulse is dictated by the amount and polarity of phase shift required. The polarity of the current pulse flowing on wires 40 and 42 is the same so that the direction of the magnetic field induced in the leg of toroid 30 adjacent to slab 20 is opposite from the direction of the magnetic field induced in the corresponding adjacent leg of toroid 32. This provides for the nonreciprocal phase shifting function. The ferrite region which makes the most significant contribution to the phase shift is that of the legs immediately adjacent to the dielectric slab 20, since an applied electromagnetic wave decays rapidly outside dielectric slab 20. The remaining legs of the ferrite toroids are present to provide a closed flux path in the magnetic circuit and contribute little to the phase shift, or to the insertion loss of the device. The device of FIG. 1 was constructed using a dielectric slab 250 mils high and 100 mils thick with a $K=50$ and ferrite toroids 5 in. long, 250 mils by 220 mils in cross-section, 55 mil thick legs, and $K=18$. All dielectric constants used herein are referenced to that of air, where for air $K=1$. The ferrite used is spinel ferrite whose saturation magnetization is 1200 Gauss. Its dielectric loss tangent is approximately $5\times10^{-4}$ and its dielectric constant is approximately 18. Any garnet or spinel ferrite can be used, however, to achieve a low insertion loss, the dielectric loss tangent should be less than $10^{-3}$ and its saturation magnetization, in Gauss, should be less than $0.8\times$Operating Frequency$/2.8\times10^6$. In general, the length of the device is dictated by the amount of phase shift required, as is well-known. To test the device, a set of matching transformers having three steps was used to couple a full-sized waveguide ($1.872''\times0.872''$) to a heavily dielectrically loaded reduced-height waveguide ($0.75''\times0.25''$) section. A dielectric plug was used to couple the reduced height waveguide to the device. For the device described above, the magnetization in the ferrite material is switched by means of wires which run longitudinally down the core of the ferrite toroid. By passing a current pulse of a predetermined polarity and time duration, the magnetic flux in the toroid can be set to any predetermined value between the two major hysteresis loop remanent magnetization states. The magnetic flux direction being clockwise or counter-clockwise in both toroids. Equal magnitude, but opposite direction for the magnetization in the two adjacent legs, is the common mode of operation. It is also possible to have a phase shifter where the adjacent legs do not have opposite polarity and equal magnitude, but are varied in some other prescribed manner to produce a variable phase shift. The device just described has the following measured characteristics: insertion loss of 3.5 dB at 6 GHz, reflection coefficient of 4.5 dB at 6 GHz (VSWR=2.67), and saturation phase shift of 720° at 6.0 GHz, as seen in FIG. 2. Using a dielectric slab thickness of 60 mils, as normally found in dielectric loaded conductive waveguide phase shifters, resulted in a device having a large reflection coefficient and having a tendency to radiate from the exposed portion of the dielectric slab. Different slab thicknesses were tried to obtain better containment of the microwave energy and reduce cross-coupling. FIG. 2 shows the phase shift as a function of dielectric slab thickness for three different frequencies, 5.5 GHz, 6.0 GHz and 6.7 GHz. The phase shift was measured by driving the ferrite toroids to saturation first in one direction, then in the other and measuring the change in phase shift. For a slab thickness range of 100–120 mil, the phase shift is large, around 600° and is almost independent of the frequency for the selected range. For thicker slabs, the phase shift falls off, since the fields at the ferrite-slab interface are decreased, while for thinner slabs, the energy is not confined as well. One of the important guidelines for producing a device having useful characteristics is then the proper selection of the dimensions of the dielectric waveguide. For a rectangular dielectric slab, its thickness should be between 0.25 to 0.6 of the free space wavelength, $\lambda_o$, divided by the square root of the relative dielectric constant of the slab, $K_s$, in order to provide for adequate containment of the propagating wave and still maintain adequate amounts of phase shift. Optimum performance appears to occur when the dielectric slab thickness is approximately $0.35\lambda_o/\sqrt{K_s}$.

Figure 3:
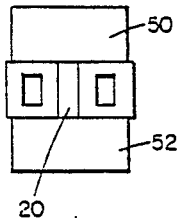
FIG. 3 shows an elevation view of another embodiment of the phase shifter.

In order to further characterize the performance of the device of FIG. 1, it is modified, as shown in FIG. 3, by the addition of ferrite slabs 50 and 52 over the exposed portion of dielectric slab 20. This is done to create an additional dielectric boundary over the two exposed sides in order to further contain the electromagnetic wave and reduce the cross-coupling between stacked devices in phase shifter array applications. Measurements were taken at 5.5 GHz for the device of FIG. 3 using a dielectric slab thickness of 60 mils and an overall device length of 5 in., and the results are summarized in the following table next to similar measurements for a conventional waveguide-type phase shifter.

TABLE I

| | Dielectric Device | Waveguide Device |
|---|---|---|
| Length | 5 in. | 5 in. |
| Insertion Loss | 3 dB | 2 dB |
| Reflection Coeff. | 9 dB (VSWR = 2.1) | 14 dB (VSWR = 1.5) |
| Phase Shift | 420° | 680° |
| Cross-Coupling | 10 dB | None |

Figure 4:
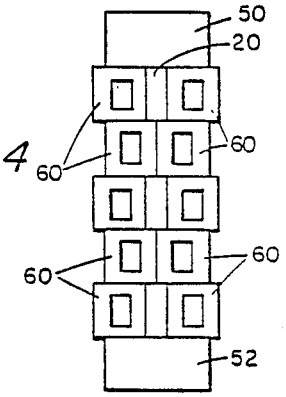
FIG. 4 shows an elevation view of the embodiment used to measure cross-coupling for the embodiment of FIG. 3.

The cross-coupling for the structure of FIG. 3 was measured by stacking similar structures to create a vertical array of phase shifters, as is done in FIG. 4. Here the immediate cladding is provided by ferrite toroids 60, which were used for their availability. However, they could be replaced by any dielectric having a dielectric constant greater than that of air and smaller than that of the dielectric bar 20, such as ferrite slabs similar to the ferrite slabs 50 and 52.

Figure 5:
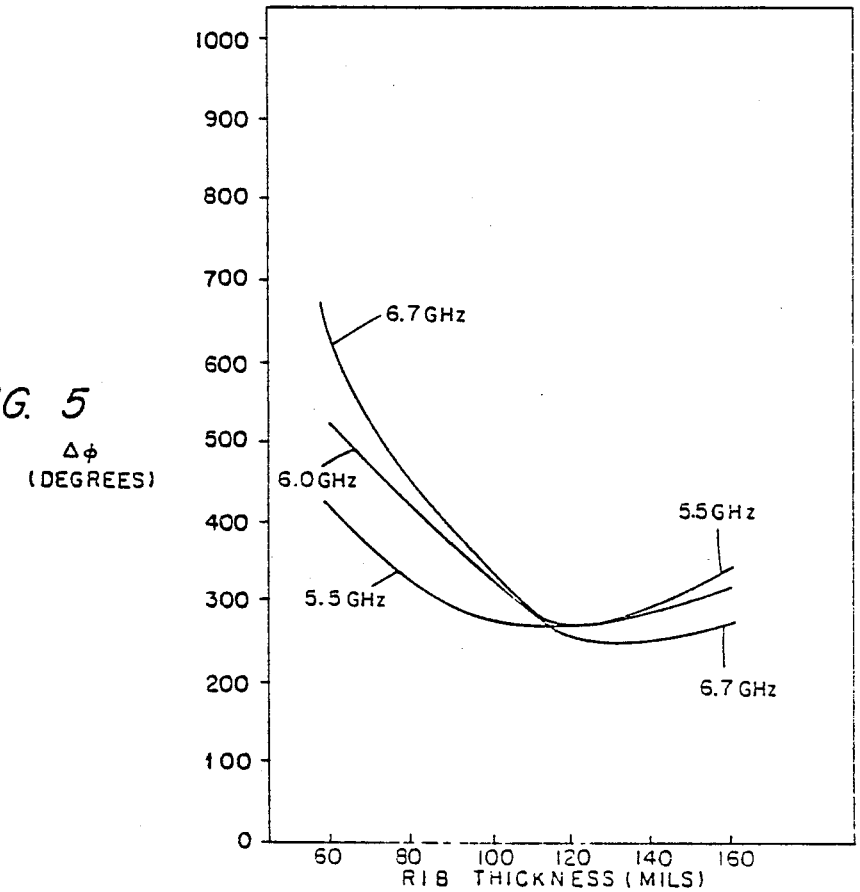
FIG. 5 shows a graph of achievable phase shift as a function of the thickness of the dielectric slab for the embodiment of FIG. 3.
Figure 7A:
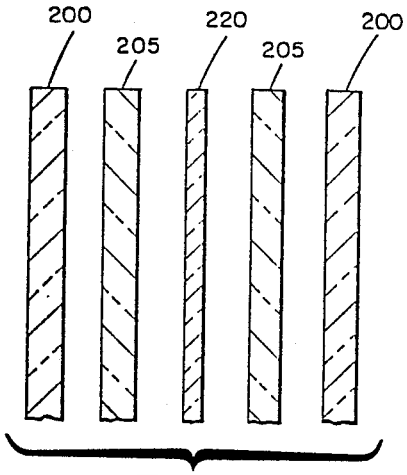
FIGS. 7A–7F show the various stages for the manufacturing of the phase shifter array of FIG. 6.
Figure 7D:
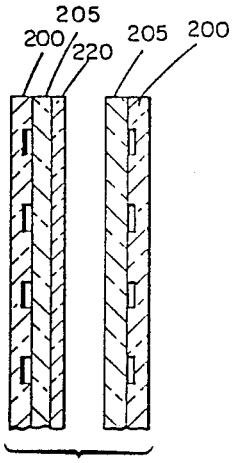
Figure 7B:
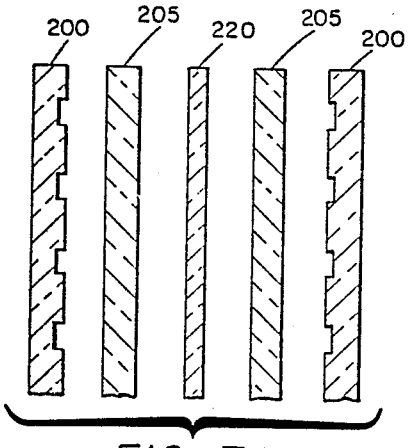
Figure 7E:
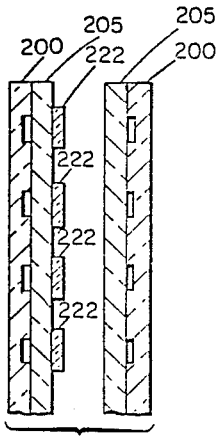
Figure 7C:
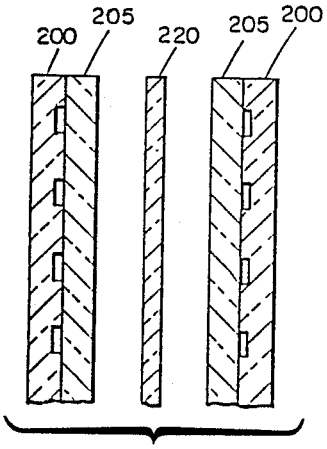
Figure 7F:
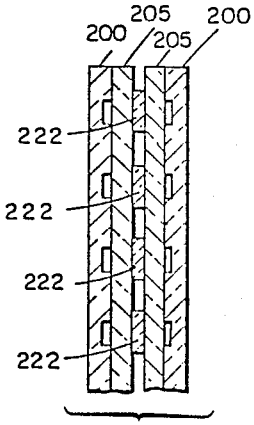

FIG. 5 shows the phase shift for three frequencies as a function of dielectric slab thickness for the device of FIG. 3. The phase shift decreases for thicker slabs, as expected from the decrease of the microwave fields at the ferrite dielectric interface. The phase shift also decreases overall probably due to the effect of the cladding ferrite bars, since some of the microwave energy is now confined outside the active area defined by the volume between toroids 30 and 32.

It was found that, for the frequency range used herein, a device employing a thickness of dielectric slab 20 of the order of one-third wavelength of the wave in that dielectric medium has satisfactory characteristics for a phase shifter and does not require additional cladding to improve confinement of the wave. However, there is the option of cladding the otherwise exposed sides of the device with a dielectric material of intermediate dielectric constant to further tailor the device performance to a predetermined application.

Figure 6:
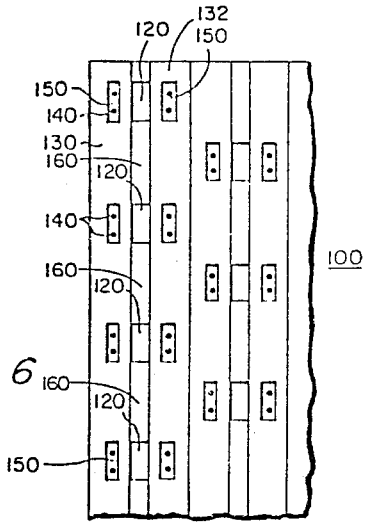
FIG. 6 shows an elevation view of an embodiment for a phase shifter array.

Referring now to FIG. 6, there is shown an elevation view of a phase shifter array 100 which can be constructed using the principles of this invention. The first column of array 100 is formed by two sheets of ferrite 130 and 132 which enclose a plurality of rectangular shaped high-K dielectric bars 120. Dielectric bars 120 are positioned parallel to, and at a predetermined distance from, each other. The ferrite sheets have ducts 150 adjacent to, and parallel to, dielectric bars 120 for allowing the threading of magnetizing wires 140. The magnetic fields produced by wires 140 are confined in the ferrite region adjacent to ducts 150. The bulk of the portion of ferrite between vertical ducts is used to provide sufficient separation to achieve a level of cross-coupling below a predetermined value. The regions 160 between high-K dielectric bars 120 could be filled with low-K dielectric bars to further isolate adjacent vertical units. Additional columns may be positioned adjacent to one another to produce an array of predetermined number of phase shifter elements.

The input and output ports for each phase shifter may be formed by extending the dielectric bars 120 beyond the input and output array surfaces. These protruding portions, not shown, can then be covered by a layer of intermediate dielectrics to provide for impedance matching. The intermediate dielectric may be a dielectric button which is used to cap the protruding portions of dielectric bars 120.

Referring now to FIG. 7, there is shown the various steps for a manufacturing method suitable for producing the phase shifter array of the present invention. Starting with FIG. 7A, there is shown the main component for forming one phase shifter column, two sheets each of ferrite 200 and 205, and a dielectric sheet 220. The first step, FIG. 7B, is to grind grooves in the two ferrite sheets 200 for receiving the switching wires and for forming the three sides of the ferrite toroids which act as the keeper for the magnetic flux generated by the switching wires. The next step, FIG. 7C, is to bond these two keeper ferrite sheets 200 to respective ones of ferrite sheets 205. Ferrite sheets 205 provide the remaining side of the toroids and are the sides that produce phase shift. The surface of phase shifting ferrite 205 that is bonded to the ground surface of keeper ferrite 200 must be sufficiently smooth to avoid any air gaps, or the bonding material must have a suitable dielectric characteristic so that it can be used to fill any gap. If necessary, the phase shifting and keeper ferrite 200 and 205 can then be ground to a predetermined thickness. The steps depicted in FIGS. 7A–7C are not necessary if ferrite sheets of appropriate dimension can be extruded already containing parallel passages therein, or if it is more convenient to drill these passages on a single ferrite sheet. The next step, FIG. 7D, is to bond dielectric sheet 220 to one of the ferrite sheets 200–205 combination. It is important to use a bond that is flexible over the operating temperature range, in order to relieve the stresses that might arise due to the different coefficient of expansion between the ferrite and dielectric used in a predetermined application. If necessary, the dielectric sheet bonded to the ferrite combination can be ground to the required thickness, since the structure is now sufficiently rigid. The next step, FIG. 7E, is to grind away portions of the dielectric sheet 220 in order to form dielectric ribs 222 opposite the switching wire passages. Finally, FIG. 7F, the second ferrite 200–205 combination is bonded to the ferrite dielectric assembly. Dielectric ribs of intermediate dielectric constant may be placed between adjacent dielectric ribs 222 in order to provide further isolation between an adjacent phase shifter, as discussed hereinabove. In the event further reduction of cross-coupling is desired, it is possible to deposit a conductive layer on the two narrow surfaces of each of the dielectric ribs 222 with some small sacrifice of the phase shift and insertion loss characteristics of the device. The dielectric sheet 220 should also overlap the ferrite 200–205 combination so that the remaining dielectric ribs 222 will protrude at either end of the phase shifter column for providing an interface to an impedance matching element.

Figure 8:
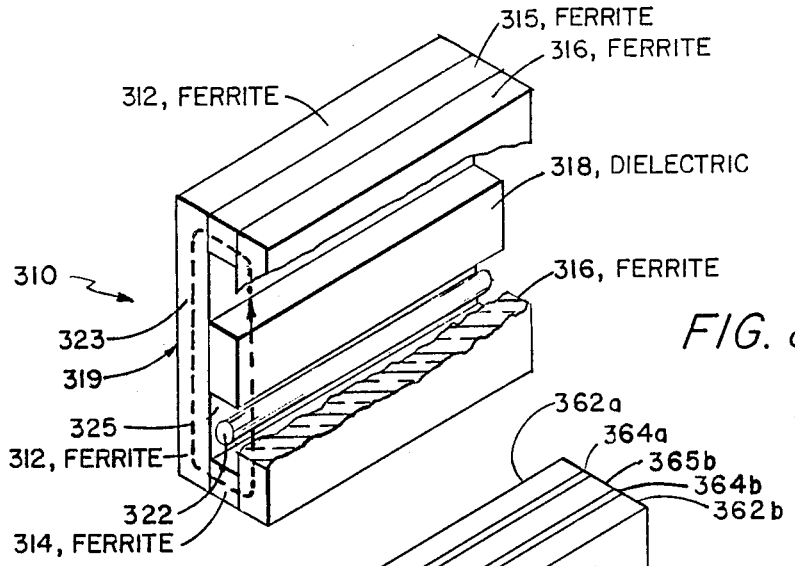
FIG. 8 is an isometric view partially broken away of an alternate embodiment of the phase shifter including a dielectric member disposed within a ferrite toroid.

Referring now to FIG. 8, an alternate embodiment of a phase shifter 310 is shown to include a pair of ferrite sheets 312, 316 and a pair of ferrite bars 314, 315 arranged together to provide a closed magnetization path denoted by an arrow 323. Here said ferrite sheets 312, 316 and ferrite bars 314, 315 are arranged to form a toroid 319. Disposed through the inner portion of said toroid 319 is here a dielectric member 318, here a bar which is here bonded between surface portions of the pair of ferrimagnetic sheets 312, 316. In a similar manner, as previously described in conjunction with FIG. 1, dielectric member 318 serves as the primary channel for microwave energy. Thus, the dimensions and the dielectric constant of the dielectric member 318 and the dielectric constant of the ferrite members, particularly ferrite sheets 312 and 316, are selected to confine a propagating electromagnetic wave substantially to the dielectric member 318 and to produce a predetermined amount of electromagnetic wave leakage from the dielectric member 318. The predetermined amount of wave leakage produces ferrimagnetic interaction in adjacent portions of the ferrite sheets 312, 316. Therefore, the dielectric constants are selected such that the r.f. fields outside the dielectric member decay rapidly. The dielectric member 318 channels or confines the microwave energy by selecting the dielectric constant of the dielectric member 318 to be several times that of the dielectric constant for the adjacent ferrite materials, here ferrite sheets 312, 316 and ferrite bars 314, 315. In all other respects, therefore, the dielectric ferrite phase shifter 310 is similar to that shifter 10 of FIG. 1. Here a magnetization wire 322 is disposed through a passageway portion 325 provided between the dielectric member 318 and the ferrite bar 315. The wire 322 here serves to provide a current through the ferrimagnetic toroid 319 and to induce in said ferrimagnetic toroid 319 in response to said current a magnetization field such as described in conjunction with FIG. 1. The phase shifter 310 provides a predetermined amount of phase shift to a signal propagating through the dielectric member 318 in a similar manner as described in conjunction with FIG. 1 for the dielectric phase shifter 10.

Figure 9:
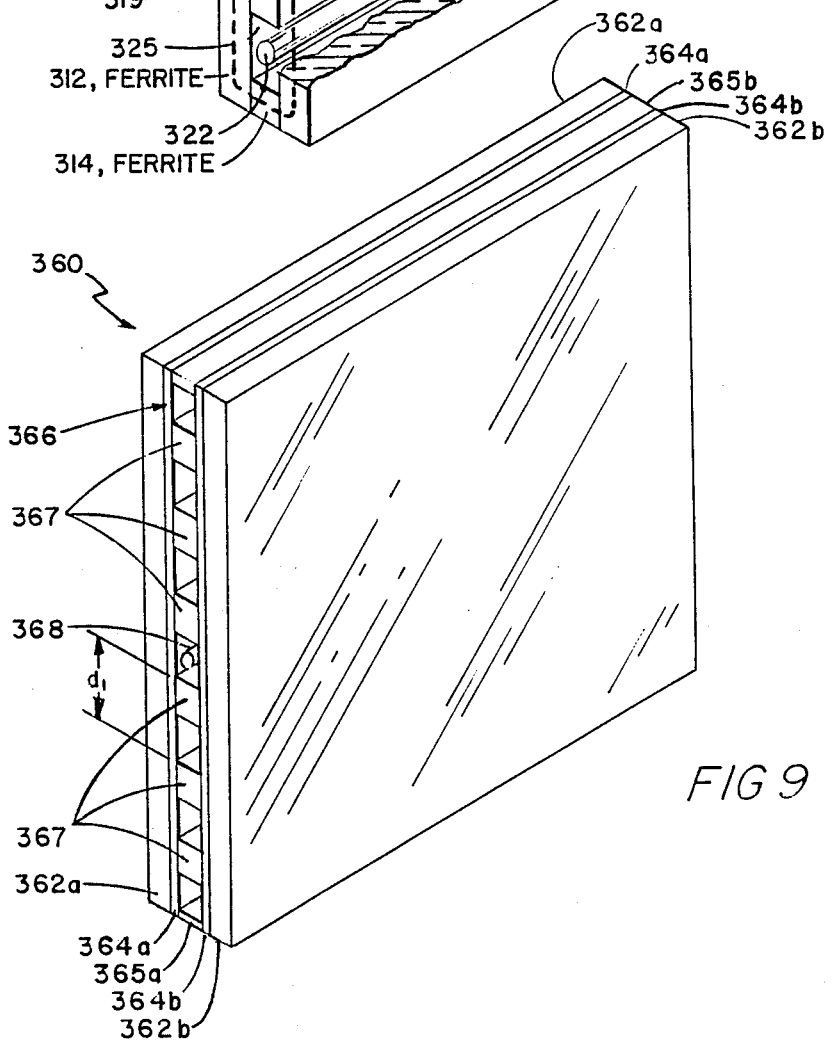
FIG. 9 is an isometric view of an alternate embodiment of the phase shifter of FIG. 8 having a plurality of dielectric members disposed within a ferrite toroid to provide a single toroid multi-element phase shifter.

Referring now to FIG. 9, a single toroid multi-element phase shifter 360 is shown to include a plurality of dielectric members 367 for confining applied electromagnetic energy substantially to each of said dielectric members 367 disposed within a common closed magnetization path as described above. The closed magnetization path is provided by a pair of ferrite sheets **364*a*, 364*b* and a pair of ferrite bars 365*a*, 365*b* arranged to form a toroid 366, as described above. The phase shifter array 360 is fabricated by first providing a first support or substrate 362*a* of a suitable nonmagnetic dielectric or conductive material. Here the substrate 362*a* is comprised of alumina. Disposed on and preferably bonded to a first facial surface portion of the substrate 362*a* is a ferrite sheet 364*a*. Ferrite sheet 364*a* is preferably ground to a desired thickness by use of flat grinding techniques subsequently to being bonded to the surface of substrate 362*a*. Disposed on and preferably bonded to peripheral surface facial portions of ferrite sheet 364*a* is the pair of ferrite bars 365*a*, 365*b*, as shown. Intermediate said ferrite bars is disposed a plurality of dielectric members 367 here spaced a predetermined distance $d_1$ where $d_1$ is typically between $\lambda_0/2$ and $\lambda_0$, where $\lambda_0$ is the free space wavelength of the nominal wavelength of electromagnetic energy fed to the single toroid multi-element phase shifter 360. Such phase shifter 360 further includes a second substrate 362***b* and the second ferrite sheet 364*b* which is preferably disposed on and bonded to the second substrate 362*b* prior to being grounded to a predetermined thickness. Subsequently, ferrite sheet 364*b* is bonded to dielectric bars 367 and ferrite bars 365*a*, 365*b*. Thus, the combination of ferrite sheets 364*a*, 364*b* and ferrite bars 365*a*, 365*b* provide the toroid 366. In a similar manner as described in conjunction with FIG. 8, ferrite sheets 362*a*, 362*b* and ferrite bars 365*a* and 365*b* provide closed magnetization path around the dielectric bars 367. A wire 368 is disposed through a passageway portion of the toroid 366 to provide a current through the toroid 366 for inducing a magnetization field therein, as described in conjunction with FIG. 1. Similarly, as described in conjunction with FIG. 8, here a plurality of electromagnetic waves are fed to the input end of said bars 367 and such electromagnetic energy waves are confined by said bars as said electromagnetic waves propagate along said bars. While the electromagnetic energy propagates along said bars, a predetermined amount of wave leakage is produced from the periphery of each one of said bars which interacts with the magnetization field provided in the closed magnetic circuit to provide a predetermined amount of phase shift as previously described. With this arrangement, the predetermined amount of wave leakage is provided from each one of said members 367 and substantially identical ferrimagnetic interaction occurs with each of such members 367 and a corresponding portion of said sheets 364*a*, 364*b* to provide each dielectric member with substantially the same phase shift. Here a single wire 368 and six dielectric members 367 are shown in the single column phase shifter array 360. Other combinations including more than one of such conductors 368 to more uniformly distribute the magnetization field in the toroid 366 and more or less than six dielectric members to guide a corresponding number of such electromagnetic waves may be included in the single toroid multi-element phase shifter 360 in accordance with the particular application.

Figure 10:
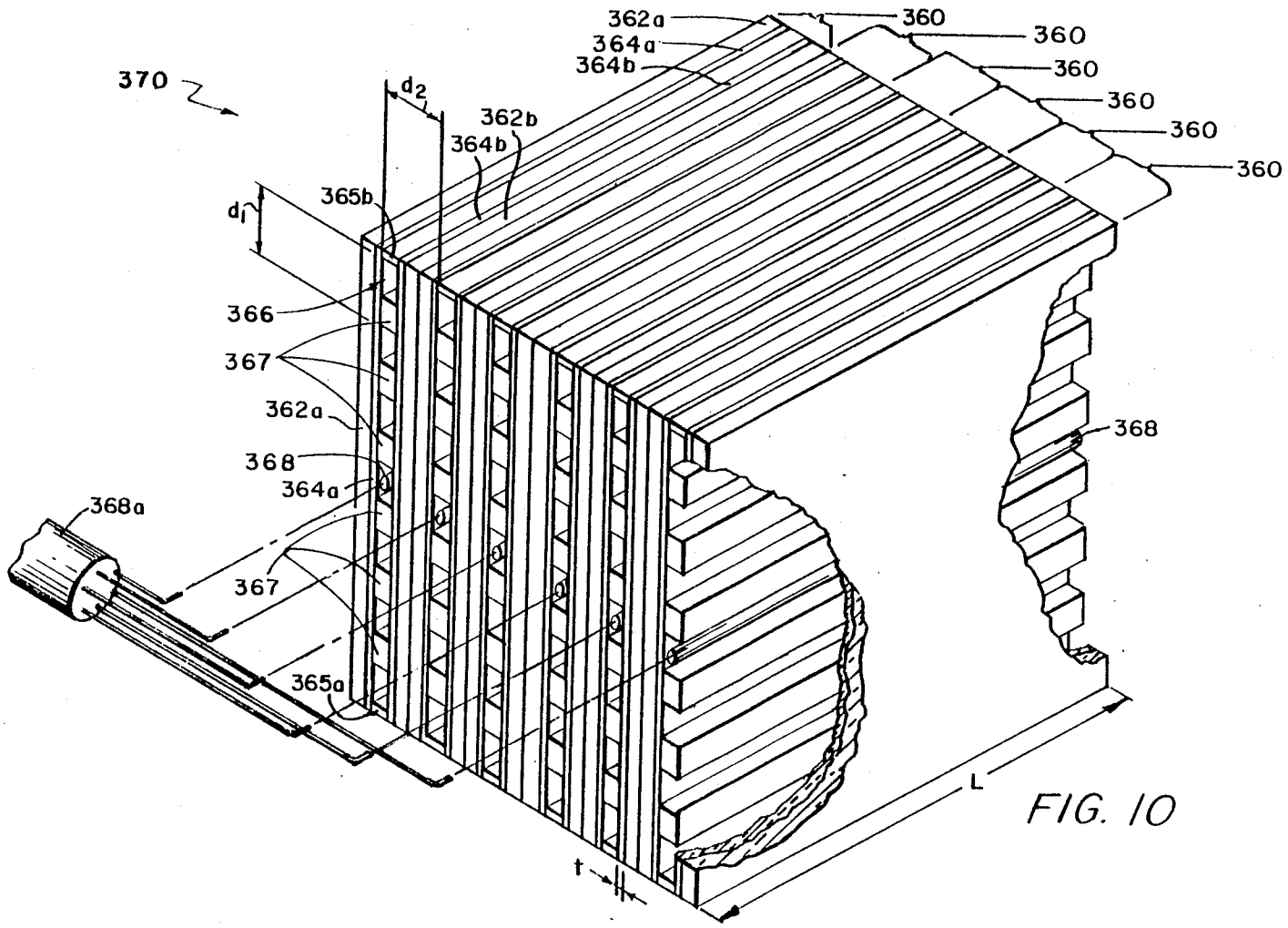
FIG. 10 is a partially broken away and partially exploded isometric view of an array module comprising a plurality of the single toroid multi-element phase shifters of FIG. 9.
Figure 14:
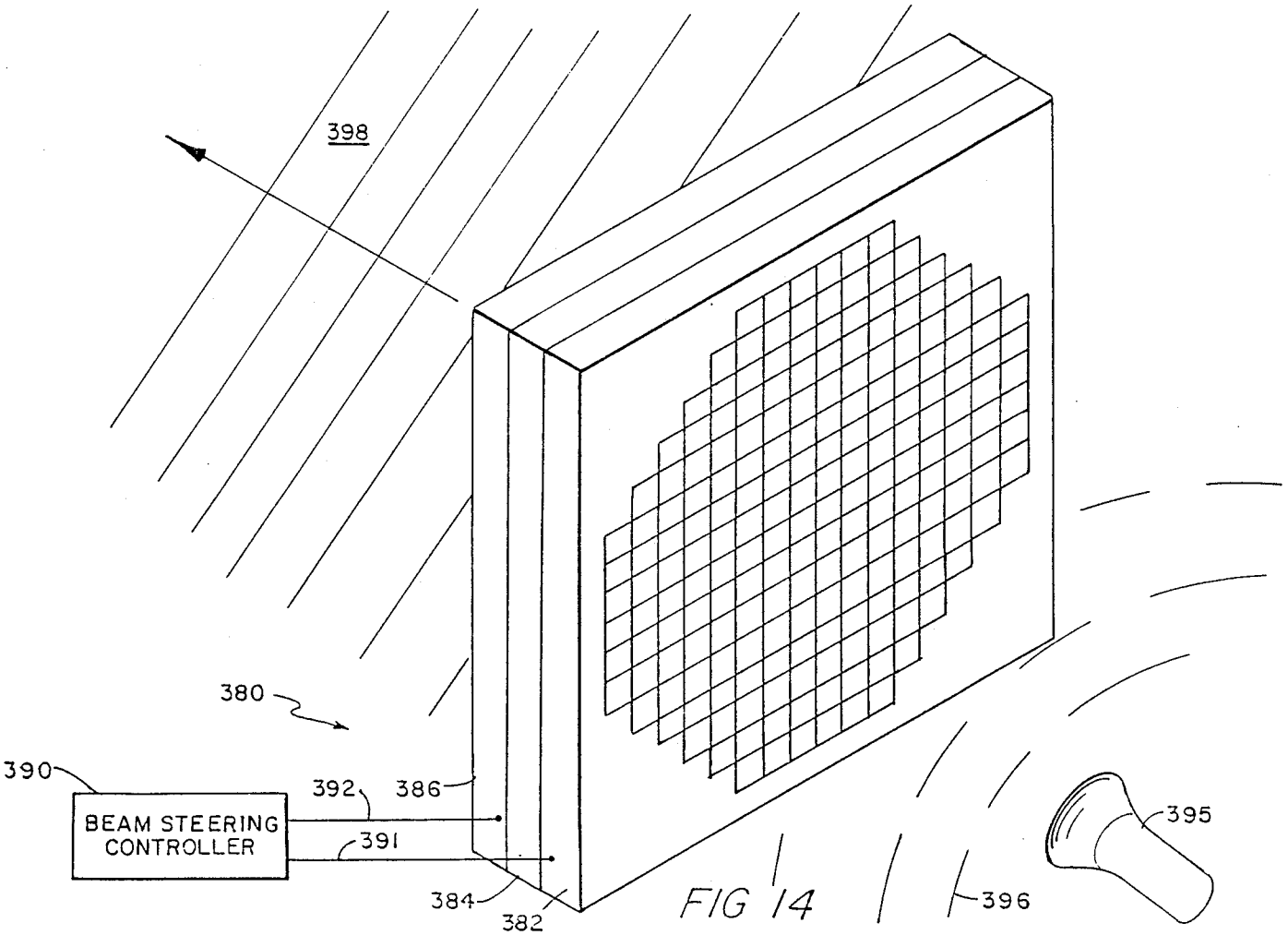
FIG. 14 is an isometric view of a phased array antenna system wherein the vertical and horizontal beam steering control functions of the array antenna system are separated between a pair of arrays with each one of such arrays including a plurality of the phase shifter modules of FIG. 10.

Referring now to FIG. 10, an array module element is shown to include a plurality of the single toroid multi-element phase shifters 360 disposed adjacent each other, as shown. Here the array module element 370 includes six-single toroid multi-element phase shifters 360 and thus forms a 6×6 matrix of dielectric members 367. However, as described above, other combinations of conductors 368 and dielectric members 367 may be used to provide the single toroid multi-element phase shifter 360 and also other matrix arrangements of the single toroid multi-element phase shifter 360 may alternately be used. Here each one of such members are spaced the predetermined distance $d_1$ in the vertical direction where $d_1$ is generally in the range of $\lambda_0/2$ to $\lambda_0$, and a predetermined distance $d_2$ in the horizontal direction where $d_2$ is generally also in the range of $\lambda_0/2$ to $\lambda_0$. Typically, the single toroid multielement phase shifters 360 are arranged such that $d_1=d_2$. Each one of the phase shifters 360 in combination with a current signal fed by conductors 368 provide an independent phase shift to the plurality of electromagnetic waves propagating along corresponding members 367, and therefore, array 370 has 6×6 or 36 dielectric elements whose phase shifts are controlled by switching currents through six conductors 368. Conductors 368 are braided or assembled together to form part of a larger cable 368*a* which is fed such current signals from a beam steering controller 390 via a bus 391, for example, (FIG. 14). The conductors are arranged such that they do not cross-over or electrically interfere with the dielectric members 367. Therefore, by placing a plurality of dielectric members 367 within a toroid 366, the phase shift of such members is controlled by a single wire 368 and thus each one of such members in such toroid is provided with the same phase shift. With this arrangement, switching of the many thousands of elements commonly encountered in large arrays is simplified.

As an example, the array module element 370 is shown as a 6×6 matrix of dielectric members 367 spaced by a horizontal distance $d_1$ and vertical distance $d_2$ where $d_1=d_2=\lambda_0/2$ to $\lambda_0$. Therefore, at a frequency of 94 GHz, for example, the thickness t of the ferrite members 367*a*, 364*b*, 365*a* and 365*b* is within the range of 4–10 mils. The free space wavelength at 94 GHz is 128 mils and therefore to be within the range of $\lambda_0/2$ to $\lambda_0$, the substrate has a thickness of 30 mils to 60 mils. Dielectric members 367 have a cross-sectional dimension selected in a similar manner as described in conjunction with FIG. 1. Here the array module elements and hence dielectric members 367 have a length L selected in accordance with the desired phase shift characteristics, as is well-known.

Figure 11:
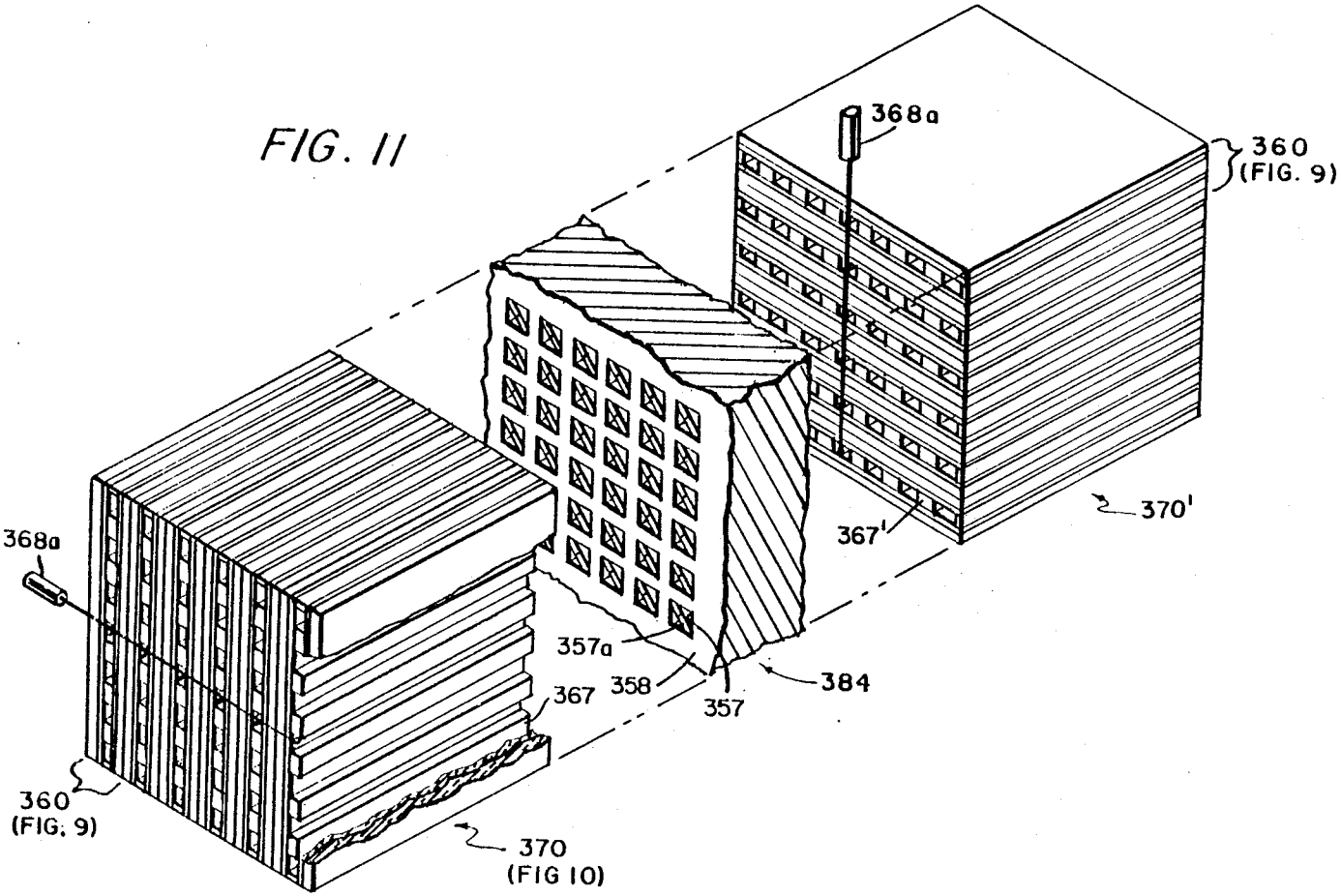
FIG. 11 is an exploded, composite partially broken away isometric view of a pair of phase shifter array modules of FIG. 10 spaced by a polarization rotational array.

Referring now to FIG. 11, a pair of array module elements 370, 370' are shown spaced by here a portion of a polarization rotational array 384. Module elements 370, 370' are also arranged such that individual ones of such dielectric bars 367, 367' are rotated by 90° about an axis through the length of said members 367, 367' to provide the pictorial arrangement shown in FIG. 12. With this arrangement, a first one 370 of the array elements 370, 370' is orientated to steer electromagnetic energy in a first one of horizontal and vertical directions, here the horizontal direction, and the remaining one 370' of the array elements 370, 370' is orientated to steer electromagnetic energy in a second one of-horizontal and vertical directions, here the vertical direction. The polarization rotational member 384 is provided to rotate the electric field polarization of the propagating electromagnetic waves by 90° such that electromagnetic energy will propagate along the members 367 associated with the first one of the arrays 370 and rotated dielectric members 367' associated with the second one of the arrays 370'.

Figures 12, 12A:
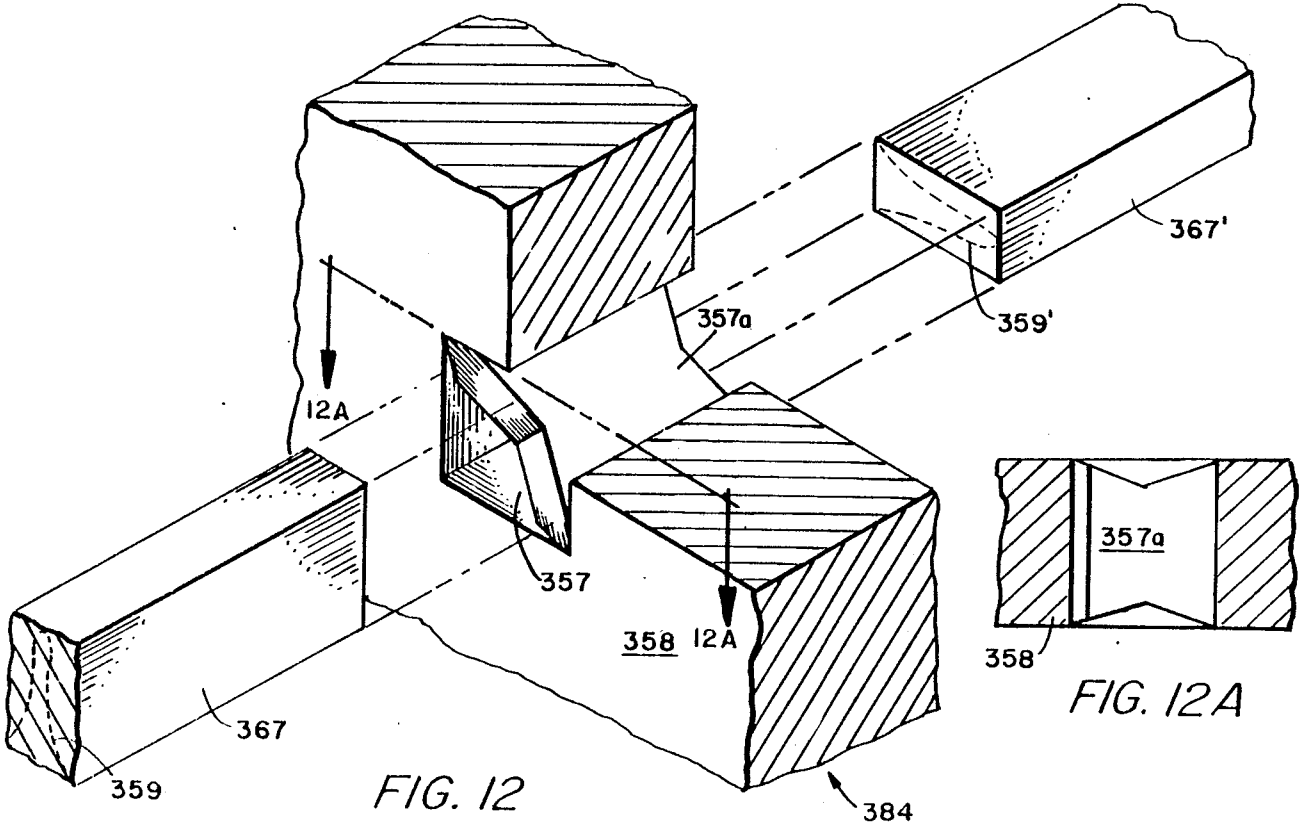
FIG. 12 is a pictorial isometric view of a pair of dielectric members spatially arranged in accordance with the embodiment of FIG. 11 depicting E-field distribution and polarization of electromagnetic energy propagating through the dielectric members with the polarization rotational array member disposed between the dielectric members.
FIG. 12A is a longitudinal view taken along lines 12A—12A of FIG. 12 showing a dielectric half wave plate having tapered edge portions which is used in the rotation member of FIG. 12.

Referring now to FIGS. 12 and 12*a*, the pictorial arrangement of dielectric member 367, the phase rotational element 384, and the rotated dielectric member 367' is shown. As depicted, the electric field (E field) distribution 359 through dielectric member 367 is substantially confined to central portions of the member 367 and has leakage portions at the periphery of the member 367 along wide sidewall portions in contact with the ferrite sheets (not shown). The rotated dielectric member 367' has a similar E-field distribution 359' except that the field is rotated by 90° in a similar manner as rotated dielectric member 367'. The E-field fed from dielectric member 367 is rotated by the phase rotation element 384 and then fed to dielectric member 367'.

The rotational array 384 comprises a plurality of elements located between respective dielectric members 367, 367' of arrays 382. 386 FIG. 14. For example, one embodiment of the rotational array 384 includes a plurality of metal waveguides 357 formed by stamping an aperture through a plate 358 with each aperture having a dielectric member 357*a* disposed diagonally through the waveguide 357 to provide a half wave plate at a 45° angle with respect to the angle of the polarization of the E-field, as shown in FIGS. 11, 12 and 12*a*. As shown in FIGS. 11 and 12, such a rotational array 384 commonly referred to as a rotary phase changer may be fabricated by providing a plate 358 having a predetermined thickness and a plurality of passageways or waveguides 357, here preferably square, through said plate 358 with each passageway 357 positioned between dielectric members 367 for each of the module elements 370. The half wave member 357*a* is then disposed at an angle of 45° with respect to the polarization of the incident wave. The half wave member 357*a* also has tapered edge portions as shown in FIG. 12*a* for the edge adjacent member 367. These tapered edge portions provide impedance matching between the dielectric members 367 and the rotational array 384. Further discussion of rotary phase changers may be found in "Foundations of Microwave Engineering" by R. E. Collins, McGraw-Hill Inc., pps. 266–268 (1968, N.Y., N.Y.).

A second embodiment of the rotational array includes a 90° ferrite Faraday rotator, such a 90° ferrite Faraday rotator being comprised of an easy-axis hexagonal ferrite ceramic which may be embedded in a Permalloy i.e., high permeability housing material (not shown). Preferably, the hexagonal ferrite is self-biasing i.e., permanently magnetized, and the metal housing is thus used to provide a return path for the magnetization. As is known in the art, a ferrite ceramic suitable to provide the Faraday rotational array described above may be fabricated by starting with a powder of the ferrite to be used and sintering the powder within the presence of an orientating magnetic field to form a ceramic having a plurality of crystallites which are longitudinally aligned along a preferred orientation determined by the orientating magnetic field. A ferrite material such as barium ferrite or barium strontium ferrite, for example, may be used and orientation would thus be along the easy-axis direction of such material. After formation of the ceramic, the ceramic might have to be polled (i.e., disposed in a second orientating magnetic field) to align all the magnetization in each crystallite in the ceramic with the same polarity or magnetic sense. A magnetic return circuit (i.e., the Permalloy structure) is then provided to reduce demagnetization field effects and provide a return path for the magnetization.

Figure 13:
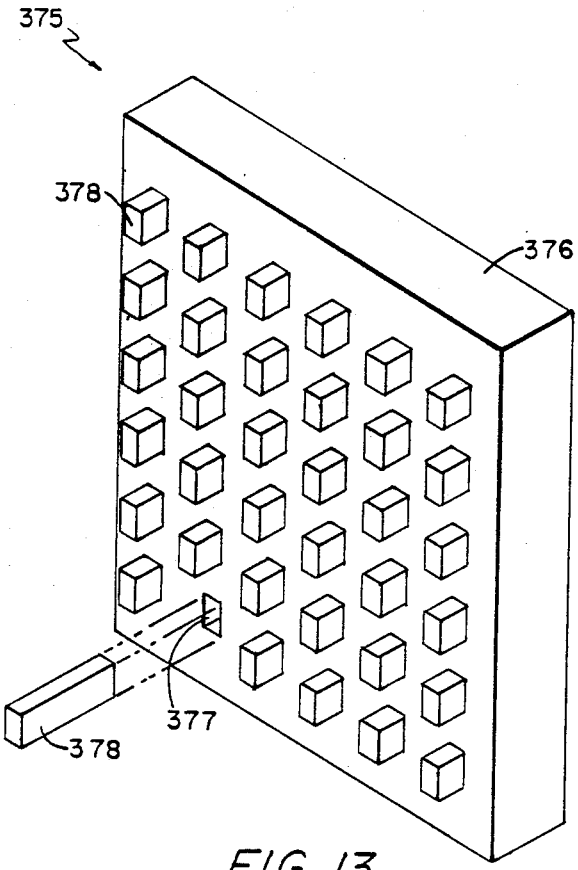
FIG. 13 is a partially exploded isometric view of an impedance matching element used to match the impedance of the dielectric members to the impedance of free space.

Referring now to FIG. 13, a wave coupling element 375 is shown to include a plate 376, here conductive, having a plurality of apertures 377 within which are inserted a corresponding plurality of dielectric members 378. Dielectric members 378 have a dielectric constant K, between the dielectric constant of free space $K=1$ and the dielectric constant of dielectric members 367 (FIGS. 10, 11, 12), ($K=50$ as described in conjunction with FIG. 1) which is selected to provide a requisite impedance match between the impedance of free space and the impedance of the dielectric member 367, as is known in the art. Each radiating facial surface of each array element 370, 370' is provided with one of such wave coupling elements 375 to match the impedance of such arrays 370, 370' at each radiating boundary of the arrays 370, 370'.

Referring now to FIG. 14, a phased array antenna system 380 is shown to include a first array 382 here including a plurality of the array modules 370 such as shown in FIG. 10 arranged to provide steering of electromagnetic energy in a first one of vertical and horizontal directions, here the vertical direction, the rotation member 384 disposed adjacent to said first array 382, and a second array 386 comprising a second plurality of array modules (FIG. 11, not shown) arranged to provide steering control of electromagnetic energy in a second one of vertical and horizontal directions, here the horizontal direction, by rotating the array elements of the second array 386 90° with respect to the array module elements of the first array 382, as described above in conjunction with FIGS. 11 and 12. Each one of such array module elements 320 is provided with one of such impedance matching elements 375 (FIG. 13), here not shown, on the external outwardly, radiating facial surface.

In operation of the phased array 380, a front of electromagnetic energy provided by an energy feed source such as a horn 395 provides a wavefront 396 which illuminates the coupling element 375 (FIG. 13). The electromagnetic energy is confined by each one of the coupling members 378 (FIG. 13) in coupling element 375 and is then coupled to corresponding ones of the dielectric members 367. The electromagnetic energy is confined by each of the plurality of dielectric members 367, such as shown in detail in FIG. 10. A plurality of magnetization current signals are provided from a beam steering controller 390 and are fed to the array on lines 391. These signals on lines 391 are distributed to respective ones of the cables 368*a*, and hence wires 368 in array 382. Such energy propagates through said dielectric members 367 and in accordance with the desired directional and collimated beam characteristics for the propagating waves, a selectable amount of phase shift determined by the current fed to wires 368 is provided to each of such waves as such waves propagate through the first array 382 to provide selected beam steering in a first one of the horizontal and vertical directions. Preferably, all of the dielectric members 367 in any column of array 352 or row of array 356 are provided with the same phase shift, thus reducing the number of wires or conductors which must be uniquely switched. The propagated electromagnetic energy is then fed to the polarization rotation array 384 and the electric field (E field) polarization of such electromagnetic energy is rotated by 90°. Therefore, such electromagnetic energy is now fed to and confined by the waveguide elements of each one of the array modules comprising the array 386 whose dielectric waveguide elements are rotated 90° with respect to array 382. In a similar manner, a plurality of magnetization signals from beam steering controller 390 are fed on lines 392 and distributed to respective ones of the wires 368 in array 386 to provide a selectable phase shift as such signals propagate through the array, providing a selectable beam steering characteristic here in a second one of the vertical and horizontal directions to said electromagnetic energy as such electromagnetic energy propagates through the dielectric members. Therefore, separate vertical and horizontal beam steering functions are provided by each one of said separate arrays 382 and 386 with the intermediate array 384 provided to change the polarization of electromagnetic energy between each one of said arrays to allow the 90° rotated dielectric members 367' of array 386, in a like manner as array 382, to confine electromagnetic energy. Therefore, collimated and directed beams 398 of electromagnetic energy are provided by selecting the phase shift characteristics of arrays 382, 386, as shown.

The above-described phased array antenna system has several advantages over conventional systems. One of the previously mentioned advantages is that the phase shifters are relatively easy to fabricate being comprised of dielectric members which are assembled together in a relatively easy fashion. The flat members such as the ferrite sheets and substrates may be fabricated by flat grinding techniques therefore allowing many of such sheets to be fabricated concurrently. Therefore, the arrangement provides for a compact array which is particularly important in high frequency applications (i.e., millimeter wave arrays) easily permitting the individual elements to be located sufficiently proximate one another (i.e., within $\lambda_0/2$ to $\lambda_0$ wavelengths). Also, in a typical phased array system, many thousands of such phase shifters may be required. With prior approaches, each element included a separate toroid which had to be individually switched. With this arrangement, the number of individual toroids in the array and hence the number of required elements needed to be switched is reduced. Further, with the abovedescribed arrangement, using separate columns and rows to provide separate vertical and horizontal steering functions, only rows or columns of such toroids are switched, thus significantly reducing the number of such elements which must be uniquely switched, and thus reducing the complexity of the array. That is, all the elements in any column of an array are provided with the same phase shift thus further reducing the number of elements which must be switched.

Figure 15:
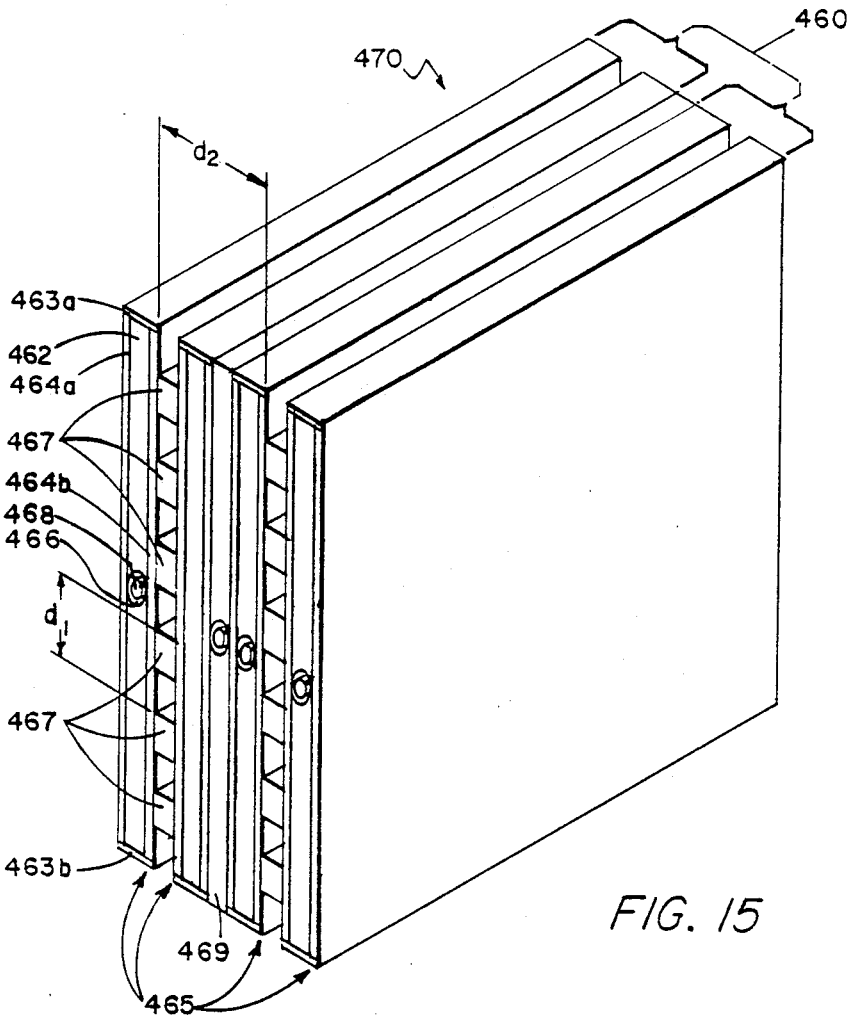
FIG. 15 is an isometric view of an alternate embodiment of an array.

Referring now to FIG. 15, an alternate embodiment of a phase shifter array 470 is shown to include a plurality of multi-element phase shifters 460. Each one of said phase shifters 460 includes a pair of closed magnetization paths 465 and a plurality of dielectric members 467, with such dielectric members 467 being disposed between said pair of closed magnetization paths 465. Each one of said phase shifters 460 are spaced and here supported by a substrate support member 469, here a sheet of a nonmagnetic conductive or dielectric material such as alumina. Each one of said closed magnetization paths 465 includes a substrate member 462 comprising a nonmagnetic dielectric or conductive material, here alumina, as described above in conjunction with FIG. 9. Disposed on and preferably bonded to facial surface portions of the substrate 465 is a pair of ferrite sheets 464*a*, 464*b* and disposed on and preferably bonded to surface edge portions of the substrate 462 is a second pair of ferrite sheets 463*a*, 463*b* which in combination with the aforesaid sheets 464*a*, 464*b* provide the closed magnetization path 465 or a toroid around the substrate. Operation of the phase shifter is similar to that described above. The dielectric constant of the dielectric members and the dielectric constant of adjacent portions of the ferrite sheets 464*a*, 464*b* are selected to substantially confine electromagnetic energy which is fed substantially to the dielectric members. A wire 468 is disposed through a passageway portion 466 provided in the substrates 462. The wire 468 here serves to provide a current through the closed magnetization path 465 to induce in said path a magnetization field such as described in conjunction with FIG. 1. In a similar manner, as described in conjunction with FIG. 1, the phase shift of a signal confined by the dielectric members 367 is varied by a predetermined amount.

Having described preferred embodiments of the invention, it will now be apparent to one of skill in the art that other embodiments incorporating its concept may be used. It is felt, therefore, that this invention should not be restricted to the disclosed embodiment, but rather should be limited only by the spirit and scope of the appended claims.

I claim:

1. In combination:

means for providing a closed magnetization path; disposed within said closed path means, for confining a plurality of propagating electromagnetic waves to said dielectric members; and means for passing a current through said closed path providing means to produce a magnetic field to vary magnetization in said closed path providing means and to provide in response to such current a predetermined phase shift to each one of such plurality of propagating electromagnetic waves.

2. The combination as recited in claim 1 further comprising:

means, including the closed magnetization path means and the confining means, for producing a small predetermined amount of wave leakage from the dielectric of the confining means; and wherein said wave leakage and said varied magnetization provide the predetermined phase shift to each of said plurality of propagating electromagnetic waves.

3. The combination as recited in claim 2 wherein said dielectric members are dielectrically spaced one from the other by a predetermined distance related to the wavelength of the propagating electromagnetic wave.

4. The combination as recited in claim 2 wherein said closed path means is a toroidal member, with said toroidal member comprising a ferrimagnetic material.

5. The combination as recited in claim 4 wherein said toroidal member comprises a pair of sheets of said ferrimagnetic material and a pair of longitudinal members of ferrimagnetic material arranged to provide the toroidal member.

6. The combination as recited in claim 5 wherein said dielectrical members are dielectrically spaced one from the other by a predetermined distance related to the wavelength of the propagating electromagnetic wave.

7. A phase shifter comprising:

a ferrimagnetic toroid;

at least one dielectric waveguide disposed within said ferrimagnetic toroid comprising:

dielectric means, including a dielectric member, for confining an electromagnetic wave fed to the member substantially to the member, and for producing a small predetermined amount of wave leakage from the member into adjacent portions of the toroid, said dielectric member having a dielectric constant of about 50 with respect to the dielectric constant of air and having a cross-sectional dimension in the range of 0.25 to 0.6 of the free space wavelength of said electromagnetic wave divided by the square root of the dielectric constant of said member;

wherein said electromagnetic wave propagating along the member is confined to said member solely by the dielectric member and dielectric media including said ferrimagnetic toroid surrounding said member; and means for directing a current through a region confined by said ferrimagnetic toroid to provide a magnetization in said ferrimagnetic toroid and to interact with said wave leakage to control the phase of the electromagnetic wave.

8. The phase shifter of claim 4 wherein said means for directing a current includes a wire disposed through the region confined by said toroid, said wire being fed by a current which changes the magnetization in said ferrimagnetic toroid.

9. The phase shifter of claim 8 wherein said ferrimagnetic toroid has a relative dielectric constant of about 18.

10. In combination:

a pair of sheets each comprising a ferrimagnetic material;

a pair of longitudinal members each comprising a ferrimagnetic material disposed between a pair of opposing facial surface portions of said sheets, said pair of sheets and pair of longitudinal members arranged to provide a toroidal member; and a plurality of dielectrics spaced apart one from the other and disposed between the pair of longitudinal members and the ferrimagnetic sheets, said dielectrics each having a dielectric constant selected to confine substantially to said dielectric an electromagnetic signal fed to said dielectric as said signal propagates along said dielectric.

11. The combination of claim 10 further comprising:

a pair of dielectric substrates with each ferrimagnetic sheet disposed over a surface of a corresponding one of said substrates; and means for passing a current through said closed path providing means to produce a magnetic field to vary magnetization in said closed path providing means and to provide in response to such current a predetermined phase shift to each one of such plurality of propagating electromagnetic waves.

12. The combination of claim ii wherein the spacing of said dielectrics is related to the wavelength of signals propagating along said dielectrics.

13. An array comprising:

(a) a plurality of elements, each element comprising:

(i) means for providing a closed magnetization path;

(ii) means including said closed path means and a plurality of dielectrics disposed within said closed path means for guiding a plurality of electromagnetic waves along such plurality of dielectrics; and (b) means for independently controlling the phase shift of the plurality of electromagnetic waves in each one of such elements.

14. The array of claim 13 wherein each of said closed path means is a toroidal member comprising a ferrimagnetic material.

15. The array of claim 14 further comprises:

means, producing a predetermined amount of wave leakage from the surface of said dielectric members;

wherein said phase shift controlling means further comprises:

(i) means for passing a current through said toroidal member to vary the magnetization in said toroidal member; and wherein said wave leakage and said varied magnetization provide the predetermined phase shift to each of said plurality of propagating electromagnetic waves.

16. The array of claim 15 wherein said toroidal member comprises a pair of sheets of said ferrimagnetic material and a pair of longitudinal members of ferrimagnetic material arranged to provide the toroidal member.

17. The array of claim 16 wherein each path means further comprises:

a pair of dielectric sheets and wherein each one of the pair of ferrimagnetic sheets is disposed over a surface of a corresponding one of said dielectric sheets.

18. The combination as recited in claim 17 wherein said dielectric members are dielectrically spaced one from the other by a predetermined distance related to the wavelength of the propagating electromagnetic waves.

19. A phase shifter comprising:

(a) a ferrite material disposed about a region;

(b) dielectric means, including a dielectric member disposed within said region, for confining electromagnetic wave energy fed to the means substantially to the dielectric member as such energy passes through the dielectric member with a minor portion of said energy leaking into the ferrite material and with said electromagnetic wave energy being confined to said member solely by the dielectric member and dielectric media including said ferrite material surrounding said member, with said dielectric member having a dielectric constant of about 50 with respect to the dielectric constant of air and having a cross-sectional dimension in the range of 0.25 to 0.6 of the free space wavelength of said electromagnetic wave divided by the square root of the dielectric constant of said member; and (c) means, including said energy leaking into the ferrite material for providing a predetermined phase shift to the propagating energy as it passes through the dielectric member.

20. The phase shifter of claim 11 wherein said means for providing a predetermined phase shift to the electromagnetic wave energy and for providing a magnetization includes a wire disposed through the region disposed around by the ferrite material, said wire being fed by a current which changes the magnetization in said ferrite material.

21. The phase shifter of claim 20 wherein said magnetically permeable material has a relative dielectric constant of about 18.

22. An array comprising:

means for providing a plurality of closed, substantially independent magnetization paths, each path further comprising:

(i) means, including a plurality of dielectric members disposed within said path, for confining substantially to said dielectric members, a corresponding plurality of electromagnetic signals fed to said dielectric members;

(ii) means, including said magnetization path for providing a selectable phase shift to the electromagnetic signals fed to said dielectric members; and wherein the phase shift provided to signals in each one of said closed paths is substantially independent from the phase shift provided to signals in remaining ones of said paths.

23. The combination as recited in claim 22 wherein each of the closed paths further comprises:

means, including the closed magnetization path and the dielectric members disposed in said path, for producing a predetermined amount of wave leakage from the surface of said members;

wherein said phase shift means comprises means for passing a current through said closed path to vary the magnetization in said closed path; and wherein said wave leakage and said varied magnetization provide the predetermined phase shift to each of said plurality of propagating electromagnetic waves.

24. The combination as recited in claim 23 wherein said dielectric members are dielectrically spaced one from the other by a predetermined distance related to the wavelength of the propagating electromagnetic signal.

25. The combination as recited in claim 23 wherein each closed path is a toroidal member, with said member comprising a ferrimagnetic material.

26. The combination as recited in claim 25 wherein said toroidal member comprises a pair of sheets of said ferrimagnetic material and a pair of longitudinal members of ferrimagnetic material arranged to provide the toroidal member.

27. The combination as recited in claim 26 wherein said dielectric members are dielectrically spaced one from the other by a predetermined distance related to the wavelength of the propagating electromagnetic signal.

* * * * *